US008136178B2

(12) United States Patent
Lerma

(10) Patent No.: US 8,136,178 B2
(45) **Date of Patent: *Mar. 20, 2012**

(54) RETRACTABLE ROTATING SPA SPEAKER SYSTEM

(75) Inventor: Ruben J. Lerma, Santa Clarita, CA (US)

(73) Assignee: B & S Plastics, Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/886,236

(22) Filed: Sep. 20, 2010

(65) Prior Publication Data

US 2011/0035873 A1 Feb. 17, 2011

Related U.S. Application Data

(63) Continuation of application No. 10/933,969, filed on Sep. 3, 2004, now Pat. No. 7,814,583.

(60) Provisional application No. 60/500,900, filed on Sep. 4, 2003.

(51) Int. Cl.
*A47K 3/00* (2006.01)

(52) U.S. Cl. ..... 4/541.1; 4/559; 4/661; 381/334; 381/345

(58) Field of Classification Search ..... 4/541.1, 4/546, 548, 559, 661; 381/334, 345
See application file for complete search history.

(56) References Cited

U.S. PATENT DOCUMENTS

| | | | | |
|---|---|---|---|---|
| 6,427,258 | B1 * | 8/2002 | Gooley | 4/559 |
| 7,055,186 | B2 * | 6/2006 | Lauter et al. | 4/541.1 |
| 7,814,583 | B2 * | 10/2010 | Lerma | 4/541.1 |
| 2004/0156517 | A1 * | 8/2004 | Schmidt et al. | 381/334 |

* cited by examiner

*Primary Examiner* — Tuan N Nguyen
(74) *Attorney, Agent, or Firm* — Koppel, Patrick, Heybl & Philpott

(57) ABSTRACT

A spa speaker apparatus having a housing with a speaker mounted therein, wherein the speaker can be extended and retracted with respect to the housing and the speaker is also rotatable within the housing. A system for providing audio to a spa is also disclosed. The system comprises a spa having walls and at least one speaker unit mounted to a spa wall. Each of the speaker units is capable of receiving an audio signal, and generating sound towards the occupants of the spa. Each of the speaker units comprises a speaker that is individually retractable to be hidden behind the spa wall and extendible from the spa wall. Each of the speakers is also rotatable within the spa wall to direct the speaker sound.

25 Claims, 5 Drawing Sheets

FIG. 5
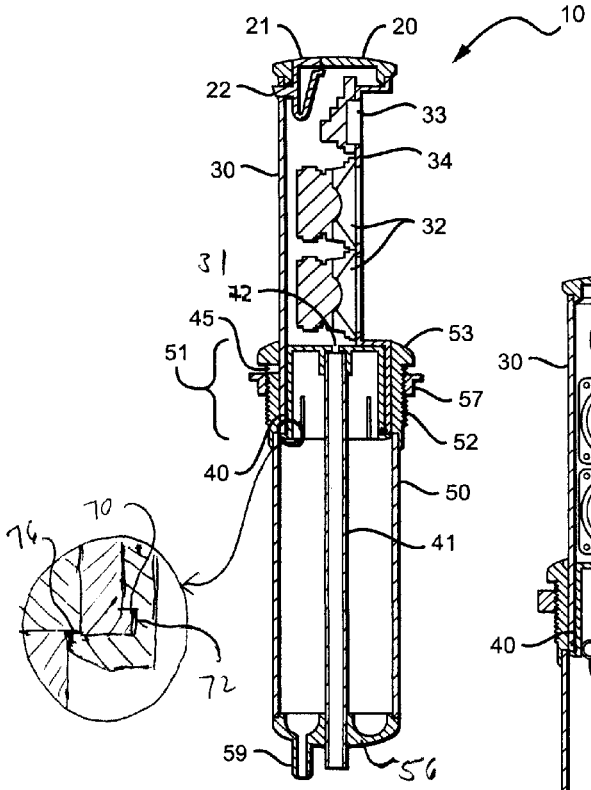
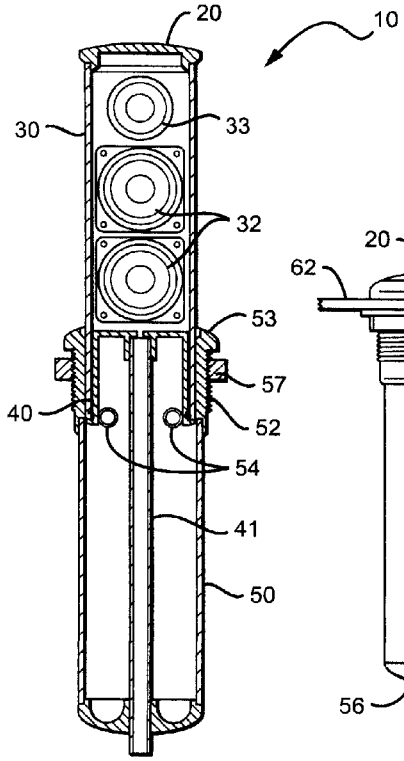
FIG. 6
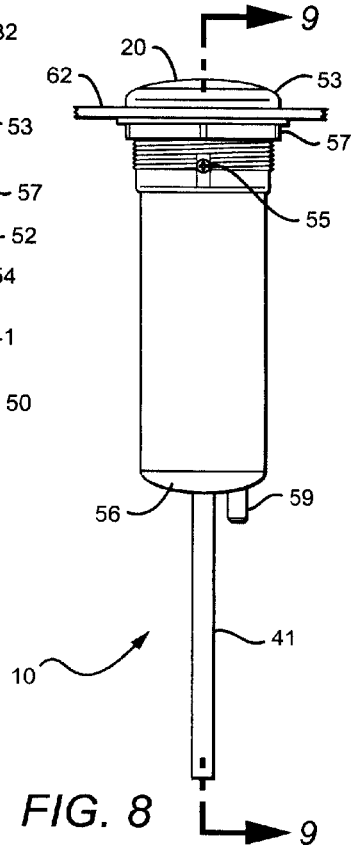
FIG. 8

FIG. 9
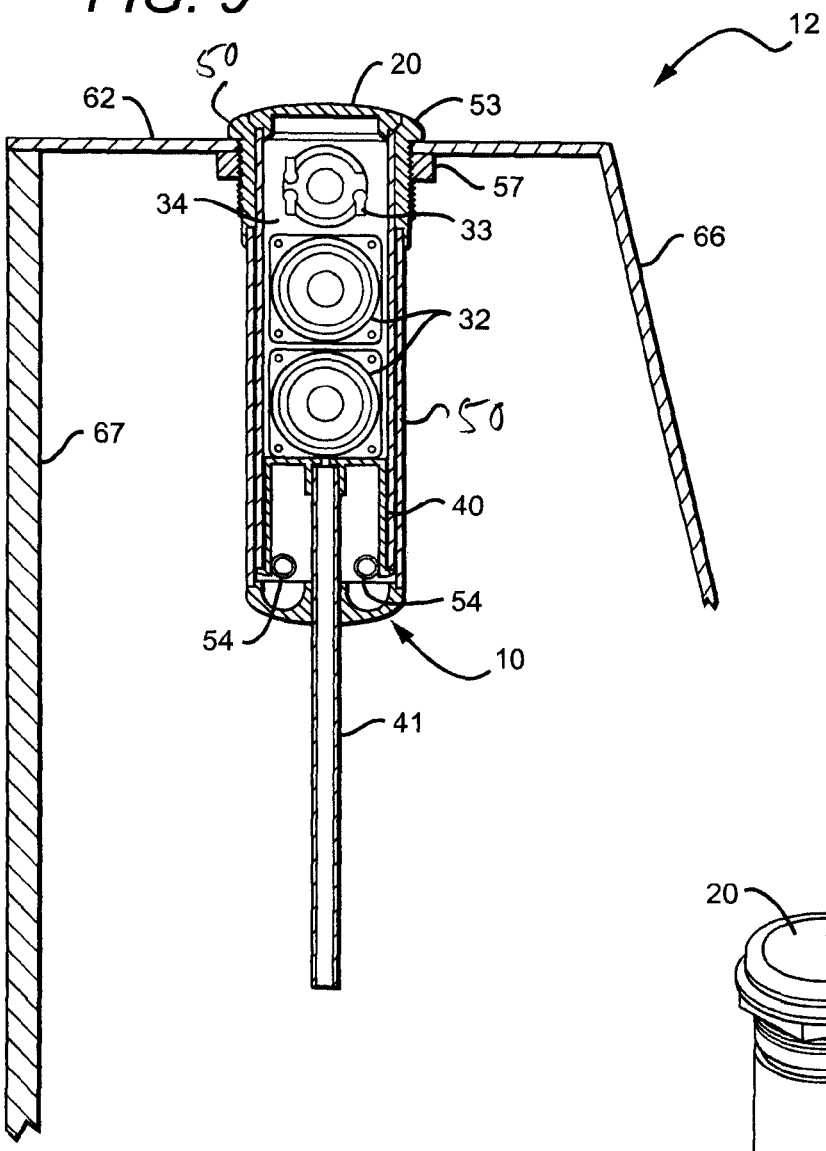
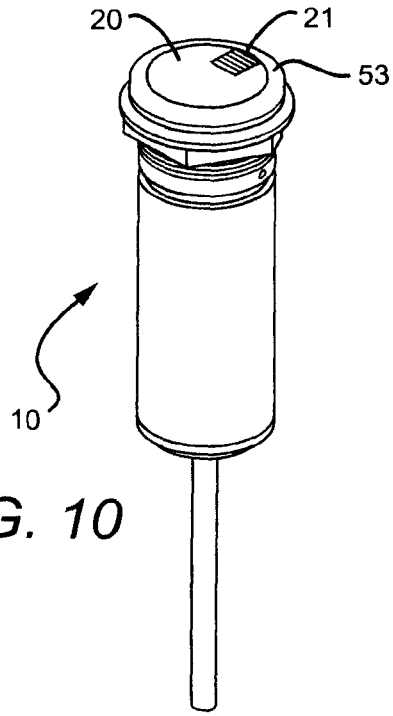
FIG. 10

FIG. 11
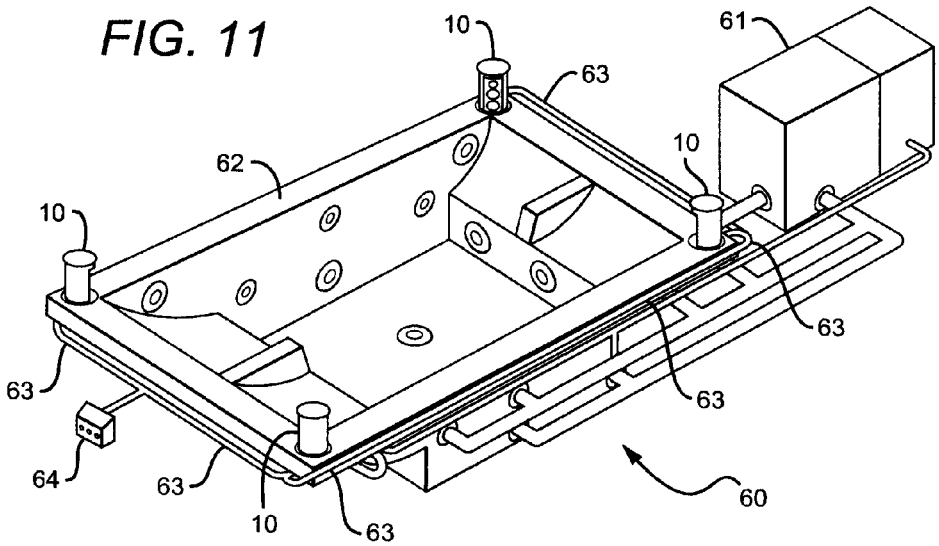
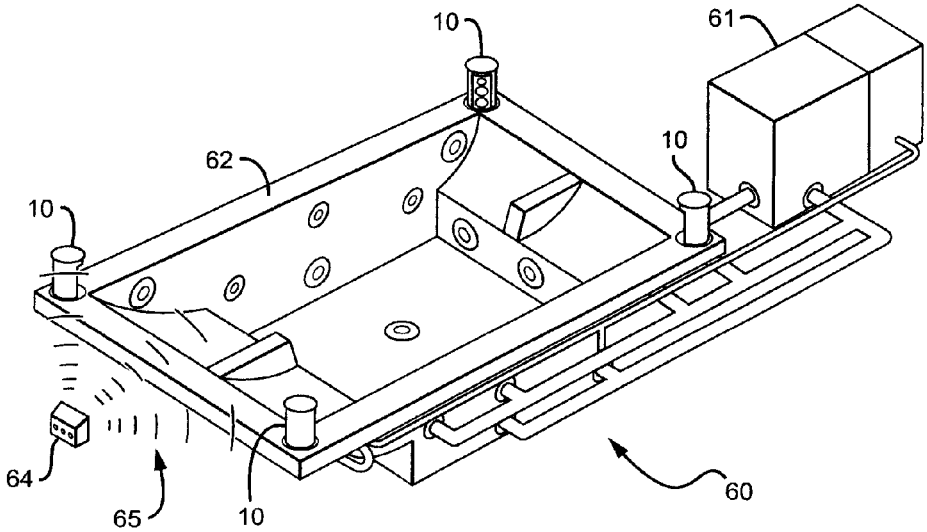
FIG. 12

RETRACTABLE ROTATING SPA SPEAKER SYSTEM

This application is a continuation of U.S. patent application Ser. No. 10/933,969 to Lerma, which was filed on on Sep. 3, 2004 now U.S. Pat. No. 7,814,583 and claims the benefit of provisional application Ser. No. 60/500,900 to Lerma, which was filed on Sep. 4, 2003.

BACKGROUND OF THE INVENTION

1. Field of the Invention

This invention relates to spas and more particularly to a retractable rotating speaker system for spas.

2. Description of the Related Art

Recreational or therapeutic reservoirs of water such as pools, spas, bathtubs and the like (collectively referred to as "spas" or "spa") are more commonly being constructed with features such as televisions and audio systems. For the occupants of the spa to hear the television or audio system, a number of speakers can be included around the spa, with a common location for the speakers being the edge of the spa above the waterline. The speakers are arranged so that the sound they produce is directed toward the spa occupants and can be heard over the noise of the spa's plumbing system.

One conventional way of mounting speaker systems around the edge of spas having Acrylic or fiberglass spa bodies is to form "ears" or extensions in the spa body and to mount a respective speaker in each of the ears. The ears may be formed during the spa fabrication process to provide fixed and permanent housings for the speakers. The ears are usually arranged around the edge of the spa and extend above the edge, with a typical location being in the corners of a rectangular or square spa. When the speakers are installed in the ears, their sound is directed in toward the spa occupants. One example of these ears may be purchased in the Excalibur series spas available from Dynasty Spas of Athens, Tenn.

One of the disadvantages of this type of spa speaker system is that the extra step of forming the ears in the acrylic or fiberglass body can add significant cost to the spa. Spas with ears also require additional storage and shipping space because the ears extend above the top surface of the spa. Shipping and storing of these spas can also be awkward because the ears prevent the spas from being stacked on top of one another with stability. The ears can also make it difficult to produce a cover that closely fits over the spa, and are not adaptable to different seating arrangements for the spa occupants.

Other spa speaker systems have been developed with speaker housings that extend from the top edge of the spa during use and can then be retracted below the edge when not in use. Holes are formed in the surface of the spa shell around the edge of the spa and the speakers are mounted within the holes. When the speaker housings are fully retracted, their top surfaces are substantially flush with the surface of the spa. The speaker housings may be restored to their non-retracted operating position with the force of an air pump/cylinder, hydraulic system or electric hoist, all of which are usually housed behind the wall of the spa body and push the speakers up from the bottom. The speakers may be connected to a common air or hydraulic driving system so that the air or hydraulic extenders may be simultaneously actuated to simultaneously extend the speaker housings. One example of such a system may be purchased from Cal Spas of Pomona, Calif.

In these types of speaker systems each speaker can require its own air, hydraulic or electronic actuator, and at least one actuator driving system. The actuators and their driving systems can add significant cost and complexity. The space behind the wall of a spa is also often at a premium, particularly for portable spas. The plumbing and electrical systems consume much of the space behind the spa wall, leaving little space for speakers. Speaker systems with air, hydraulic or electrical actuators can consume precious space behind the spa wall.

Conventional spa speaker systems also produce a fixed sound pattern that can vary from location to location within the spa, producing a good audio experience for some of the spa occupants but a poor one for others. Furthermore, when an occupant changes his or her location within the spa the sound quality can also change, forcing him or her to choose between a desired spot in the spa and a desired sound quality. The sound produced by conventional spa speaker systems is focused inward toward the spa occupants and typically produces poor sound quality to those outside the spa.

SUMMARY OF THE INVENTION

The present invention seeks to provide a spa speaker system that consumes less space behind the spa wall, is less costly and less complex. The invention also seeks to provide a speaker system that is easy to install and use and includes a speaker that can be easily and independently extended, retracted and rotated when extended.

One embodiment according to the invention comprises a spa speaker having a housing with the speaker mounted therein. The speaker is extendible from and retractable into and rotatable relative to the housing. Preferably the housing is mounted to a surface of the spa above the water line.

One embodiment according to the invention comprises a system for providing audio to a spa. The system comprises a spa having a wall and at least one speaker mounted to the wall. Each of the speakers is retractable to be hidden behind or beneath the wall and is extendible from the wall. Further, each of the speakers is rotatable in the extended position. Each of the speakers is extendible, retractable and rotatable independent of the other speakers in the system. Each of the speakers is capable of receiving an audio signal and generating sound toward occupants of the spa shell. An audio system generates an audio signal and transmits the signal to the speakers.

BRIEF DESCRIPTION OF THE DRAWINGS

These and further features and advantages of the invention will be apparent to those skilled in the art from the following detailed description, taken together with the accompanying drawings, in which:

FIG. 5 is a sectional view taken along section lines 5-5 of FIG. 2;

FIG. 6 is a sectional view taken along section lines 6-6 of FIG. 3;

FIG. 8 is a side elevation view of the speaker of FIG. 1, in its retracted position;

FIG. 9 is a sectional view taken along section lines 9-9 of FIG. 8;

FIG. 10 is a perspective view of the retracted spa speaker of FIG. 8;

FIG. 11 is a perspective view of a spa using spa speaker systems according to one embodiment of the present invention; and FIG. 12 is a perspective view of a spa using spa speaker systems according to one embodiment of the present invention.

DETAILED DESCRIPTION OF THE INVENTION

Figures 1, 7:
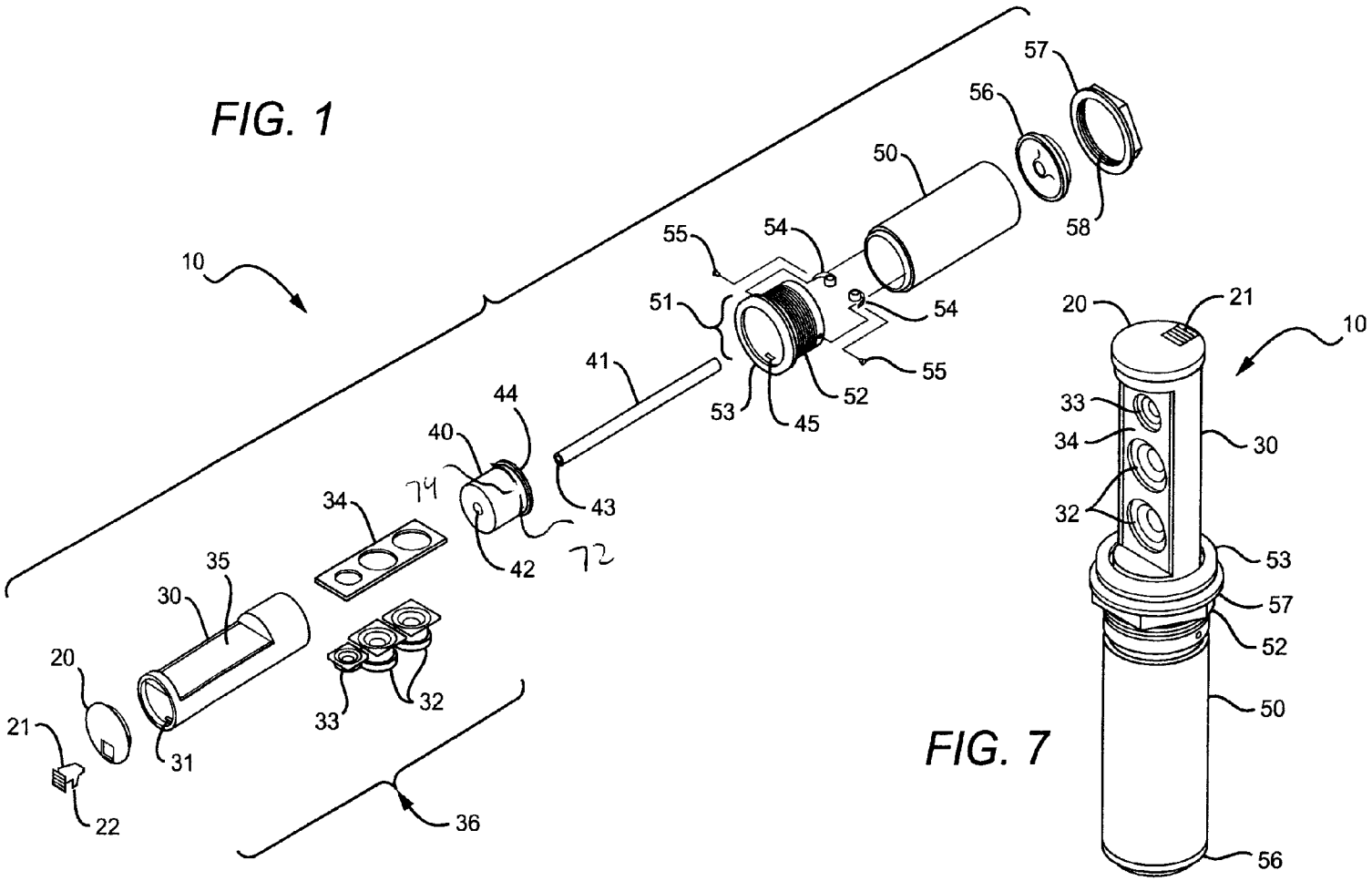
FIG. 1 is an exploded perspective view of one embodiment of a spa speaker according to the present invention.
FIG. 7 is a perspective view of the speaker in its extended position as shown in FIGS. 2-6.
Figure 2:
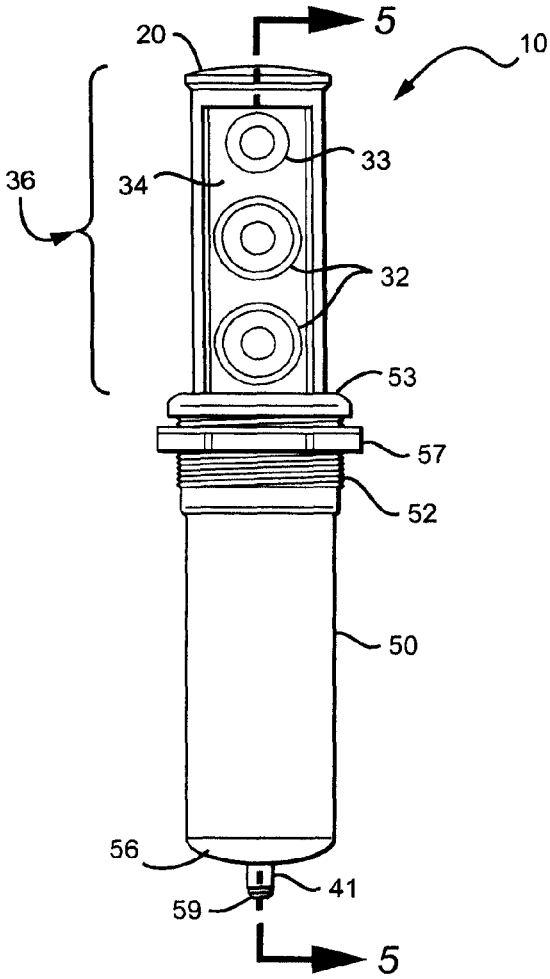
FIG. 2 is a front elevation view of the speaker of FIG. 1 in its extended position.
Figure 3:
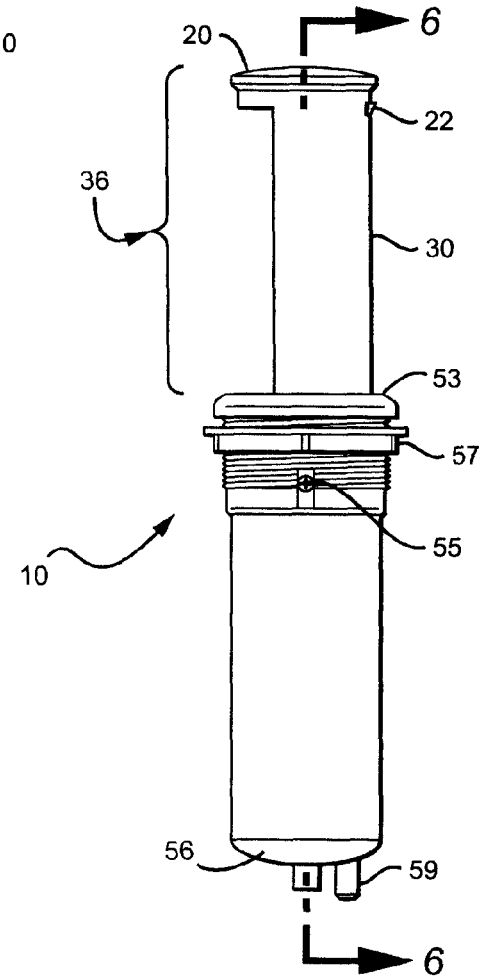
FIG. 3 is a side elevation view of the speaker of FIG. 1, in its extended position.

FIG. 1-3 show one embodiment of the rotatably extendable speaker unit 10, its internal components and how they are assembled. Most of the system's components are formed from a water impervious plastic such as chlorinated polyvinyl chloride, CPVC; polyvinyl chloride, PVC; or acrylonitrile butadiene styrene, ABS. Speaker system 10 is particularly adapted to be integrated with a spa so that it can be extended from a surface of the spa shell above the waterline, and retracted below the surface when not in use.

The spa speaker unit 10 includes an elongated cabinet 30 that has a generally cylindrical cross section and houses a speaker arrangement, which can comprise one or more different audio components of many different sizes. Cabinet 30 has speaker face plate 34 having a number of circular holes that cover circular areas having diameters approximately equal the diameter of the face of the housing's two 2" speakers 32 or tweeter speaker 33. Speaker faceplate 34 is provided as a mounting plate to hold 2" speakers 32 and tweeter speaker 33. The speakers are mounted in the shell so that sound from the speakers emits through the holes in speaker faceplate 34. Speaker plate 34 is mounted within speaker cabinet 30 through speaker opening 35. When assembled, these parts are frequently referred to as speaker 36.

Cap 20 provides the only visible surface of speaker unit 10 when the speaker unit is installed in a spa or tub surface and retracted. Cap 20 is mounted on top of speaker cabinet 30. Latch 21 may be inserted into cap 20 to provide a locking mechanism to keep speaker unit 10 retracted when not in use. Latch lock 22 of latch 21 extends through latch slot 31 in speaker cabinet 30 to engage a notch 45 in speaker upper housing 51 when speaker 36 is retracted. In one embodiment latch 21 may be operable to withdraw latch lock 22 from the notch 45 by pressing latch 21 releasing speaker 36 and allowing it to extend from a surface of the spa.

Speaker 36 is mounted on support stage 40 which has a planar top surface with a hole in its center 42 to allow speaker wires to pass through the planar top surface. Support stage 40 has stage assent stop 44 that engages a lower edge of upper speaker housing 51 as speaker 36 extends to its limit. Wire guide 41 is joined to the interior underside of the top surface of support stage 40. Wire guide 41 is a hollow cylindrical structure similar to a straw used for sipping drinks. Wire guide 41 has an upper end 43 that is attached to the interior surface of support stage 40.

Speaker 36 is placed on and over support stage 40. Speaker cabinet 30 has a tab 70 (shown in FIG. 5) on its inside cylindrical surface that is inserted into a slot 72 in the outer vertical cylindrical surface of support stage 40. The slot goes almost all the way around the circumference of support stage 40. The speaker tab once fixed in the support stage slot allows speaker 36 to be rotated relative to support stage 40. The circumferential slot in support stage 40 does not completely circle the stage so as to provide a rotation stop 74 for rotational movement of speaker 36. Speaker 36 may rotate in either direction until the tab comes to the end of the slot in support stage 40. Speaker 36 is restrained from full rotational movement to keep any speaker wires that may pass through wire guide 41 up to speakers 32 and 33 from excessive twisting.

Rotation of speaker 36 requires cabinet 30 to be cylindrical. Cylindrical cabinets are problematical, because speakers tend to require deep cones for sound projection. A cylindrical cabinet using conventional speakers would require too much wasted room behind the speaker to make rotatable speakers that may fit in small spaces. Fortunately an improvement is speaker quality has resulted in new smaller speakers useable in spas having essentially the same sound quality compared to conventional speakers. These smaller speakers allow cylindrical cabinets to be placed in small, convenient places around the spa.

In other embodiments according to the present invention, speakers 32 and 33 may be connected to an audio source wirelessly, in which case excessive rotation is not a concern. In the wireless embodiments, speakers 32 and 33 will have wireless receivers attached to them and the housing 30 can rotate completely around the support stage 40.

Upper speaker housing 51 is used to fasten speaker unit 10 to a horizontal spa surface 62 (shown in FIG. 11). Retaining lip 53 of upper housing 51 lays flush on horizontal surface 62 of the spa. Outer threads 52 match with inner threads 58 of 2" nut 57 to snuggly hold speaker unit 10 to horizontal spa surface 62.

Constant force springs 54 are mounted to an interior surface of upper speaker housing 51 by screws 55. Screws 55 hold constant force springs 54 firmly to upper speaker housing 51 while allowing the springs to unfurl into speaker housing body 50. Many different custom and commercially available springs may be used, with a suitable spring being a constant force coil spring such as those provided by Stock Drive Product/Sterling Instrument (SDP/SI) of New Hyde Park, N.Y., under part numbers A3X50-SH10J29 and A3X50-Sh10K29. The springs 54 comprise a pre-stressed strip of metal, which tightly winds around itself in successive turns to form a coil. The spring can be mounted at many different locations in embodiments of speakers according to the invention.

Speaker housing 50 is attached to upper speaker housing 51 to form an assembly. Speaker housing 50 may be adhered to upper speaker housing 51 by common waterproof adhesives. One such adhesive may be ABS glue. The inside lower edge of said upper housing comprises a housing stop 76 (shown in FIG. 5) to prevent the speaker from extending out of said housing and upper speaker housing 50,51 combination. Housing cap 56 is attached to the lower end of speaker housing body 50. Housing cap 56 has a hole in its center to provide an exit port for wire guide 41. As speaker 36 is retracted into speaker housing body 50, wire guide 41 extends through the hole in housing cap 56.

Nut 57 has interior threading 58 used to secure speaker unit 10 to horizontal spa surface 62 by combining with exterior threads 52 of upper speaker housing 51 to clamp onto the surface of spa shell 62. The upper speaker housing 51 is typically inserted in a hole in the spa wall with a close fit with the lip 53 resting on the outside of the spa surface 62. The nut 57 is turned onto the outer threads 52 until the spa surface is sandwiched between the nut and lip to hold the upper housing 51 in place. A watertight seal can be provided between the lip 53 and surface 62 by different devices such as O-rings, gaskets and sealants, although in other embodiments the necessary seal is provided by the force of the lip on the spa surface 62.

FIG. 2 shows a view of the front of speaker unit 10 with the speaker face plate 34 having two 2" speakers 32 and one tweeter speaker 33 mounted on its surface. Speaker faceplate 34 is mounted within speaker cabinet 30 and the speaker cabinet 30 is capped with cap 20. Speaker housing body 50 is suspended below a spa surface and contains speaker 36 when it is in its retracted position. Housing cap 56 seals the bottom of speaker housing 50. Housing cap 56 may be adhered to the bottom end of speaker housing 50 by such adhesives as ABS glue. The bottom end of wire guide 41 may be seen poking through and extending below housing cap 56. Wire guide 41 is designed so that at least a portion of it protrudes beneath housing cap 56 when speaker 36 is fully extended as in this figure. A drain 59 is included in the housing cap 56, behind wire guide 41 and is used to allow water that enters the speaker housing 50 to drain out.

FIG. 3 shows speaker unit 10 from the side when it is in its extended position. As described above, latch 21 is attached to the speaker cabinet 30 and as shown, latch lock 22 protrudes through the back surface of speaker cabinet 30. Screw 55 protrudes from the forward surface of upper housing and is used to fasten constant force spring 54 to the interior of upper speaker housing 51.

Figure 4:
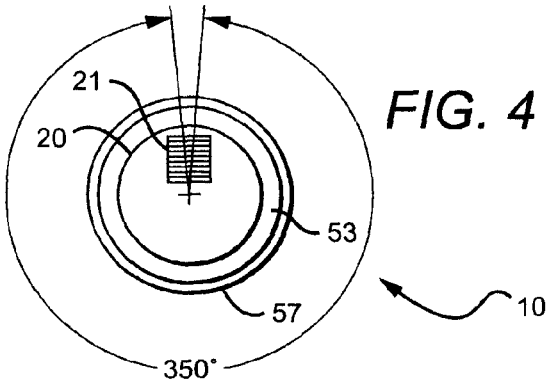
FIG. 4 is a top plan view of the speaker of FIG. 3.

FIG. 4 shows the top of speaker unit 10 with latch 21 mounted within the cap 20. Latch 21 may be activated to release latch lock 22 (shown in FIGS. 1 and 3) holding speaker cabinet 30 in its retracted position within speaker housing 50. The outer edge of retaining lip 53 of upper speaker housing 51 extends beyond the outer edge of cap 20. Beyond the outer edge of retaining lip 53 is the outer edge of nut 57. The speaker 36 is adapted to rotate in an arc approximately 350° to provide optimal sound direction for the occupants of the spa or to direct the speaker sound to persons outside the spa. When speaker unit 10 is attached to an audio system by wires, the speaker 36 should be limited in its ability to rotate to preserve the wires.

FIG. 5 demonstrates how latch lock 22 protrudes through the back of speaker cabinet 30. Tweeter speaker 33 and speakers 32 are shown mounted on speaker faceplate 34 with the speaker faceplate 34 held within speaker cabinet 30. Wire hole 42 passes through the upper surface of support stage 40 and wire guide 41 is attached to the underside of the upper surface of support stage 40 directly beneath wire hole 42. Wire guide 41 is preferably a hollow tube that traverses the distance from the bottom of the upper portion of ascending stage 42 through housing cap 56 and out of speaker unit 10. Wire guide 41 is adapted to contain speaker cable running from an audio system to speakers 32 and 33. The purpose of wire guide 41 is to form a solid shell around any speaker wires that may be running through it and through support stage 40 to connect to speakers 32 and 33. Wire guide 41 will prevent such speaker wires from becoming tangled and bunched up as speaker unit 10 is cycled through multiple extensions and retractions of the speaker 36.

Latch slot 31 is shown between retaining lip 53 and the nut 57 on the left side of speaker unit 10 in FIG. 5. Latch slot 31 is the resting place for the extreme end of latch lock 22, when speaker 36 is in its retracted position. As described above, drain 59 in the bottom of housing cap 56 provides an exit for any moisture that may accumulate in speaker housing body 50.

FIG. 6 illustrates speaker unit 10 in its extended position with speaker 36 extended fully from speaker housing 50. The faces of speakers 33 and 32 are positioned above retaining lip 53 of upper speaker housing 51. In the extended position shown in FIG. 6, speakers 32 and 33 are exposed to the spa environment to provide sound to the spa occupants. Constant force springs 54 curl under the lower edge of support stage 40. In FIG. 6 constant force springs 54 are in their fully retracted position. The tension in springs 54 supports speaker 36 in its extended position from speaker housing 50 and the springs 54 remain in their contracted position elevating speaker 36 above retaining lip 53 until such time as the speaker 36 is forced back into housing body 50 and engaging latch lock 22 (shown is FIG. 5) with latch slot 31 (also shown in FIG. 5). It is important to note that even with speaker 36 fully extended from speaker housing 50, wire guide extends partially from the bottom of support stage 40 through and out the bottom of housing cap 56.

FIG. 7 shows speaker unit 10 in a fully extended position with speakers 33 and 32 mounted on speaker faceplate 34 being fully visible above retaining lip 53. FIG. 8 is a side view of speaker unit 10 in its fully retracted position with Cap 20 forming a tight seal with upper lip 53. The seal between cap 20 and upper lip 53 may be waterproof when latch 21 (not shown) is engaged and O-rings, gaskets or sealants can be included to help form the seal. Screw 55 hold the stationary end of constant force springs 54 in place attached to upper speaker housing 51. Drain 59 extends from the bottom of housing cap 56. When speaker unit 10 has its speaker 36 retracted, wire guide 41 extends through the center of housing cap 56 and descending past the bottom of housing. Any wires connected to the speaker still pass through the wire guide to the speaker.

FIG. 9 shows speaker unit 10 in its fully retracted position mounted in a spa shell surface 62. Cap 20 and retaining lip 53 are shown to form the visible portion of the speaker unit 10 when it is fully retracted. Tweeter speaker 33 and speakers 32 are mounted on speaker faceplate 34 contained within speaker cabinet 30. Speaker cabinet 30, and therefore speaker 36, is entirely contained within speaker upper housing 51 and housing body 50. The retaining lip 53 of upper speaker housing 51 may be seen to be flush with the top of spa shell surface 62. Nut 57 is shown threaded onto outer threads 52 and in contact with the bottom of spa shell surface 62. In the fully retracted position all speaker faces 32, 33 and the speaker 36 are withdrawn from the view of spa occupants. Support stage 40 holds the ends of constant force springs 54 in their fully extended position. Constant force springs 54 in this position maintain an upward force on the bottom of support stage 40 such that when the latch 21 (shown in FIG. 5) to disengage the latch lock 22 from the slot 31, the speaker is urged to its extended position viewable by spa occupants.

FIG. 10 again shows speaker unit 10 in its fully retracted position. Latch 21 may be seen to be flush with cap 20, which forms a boundary with retaining lip 53. These three parts are molded such that there will be no jagged or obvious edges where they meet that might snag apparel or scrape the skin of the spa occupants. In one embodiment retracted speaker unit 10 may become fully extended by merely depressing latch 21.

FIG. 11 is a perspective view of a spa 60 with a number of rotatably extendable speaker units 10 arranged on horizontal surface 62 that runs around the edge of spa 60. Speaker units 10 according to the invention may be mounted in many different devices and in many different locations. Speaker units 10 are particularly adapted to use in an acrylic or fiberglass spa on top horizontal surface 62 around spa 60 that is above the waterline. Spa 60 may have one or more speaker units 10, each of which requires a hole in surface 62. Each hole is shaped similar to the housing's cross-section, but slightly larger than housing 50. Speaker units 10 according to the present invention may also be arranged at different locations that can be included in other reservoirs of water such as pools, hot tubs or bathtubs.

Spa 60 plumbing system 61 includes pumps, filters and conduits. Plumbing system 61 typically will consume much of the space behind a spa wall.

An audio system 64 generates an audio signal to be transmitted to speaker units 10 over speaker cable 63. The audio system may be any apparatus that generates an audio signal including but not limited to television, compact disc player, receiver, tape player, digital video disc player, VHS player, etc.

Each speaker unit 10 may be extended alone or in combination with other units. Each speaker may be rotated about an axis normal to horizontal surface 62 in an arc of approximately 350°. This rotation allows the each speaker to be directed at any location within the spa and many locations outside the spa. Each speaker may be rotated alone or in combination with other speakers.

FIG. 12 shows one embodiment of the invention where the connection between audio system 64 and speaker units 10 is wireless. Speaker units 10 each contain a wireless receiver that allows the unit to access wireless transmission 65, and covert that into sound to be directed into spa 60. Audio system 64 includes a transmitter for generating wireless transmission 65 for broadcast to speaker units 10. Audio system 64 may be attached to spa 60, or may be positioned near the spa as long as speaker units 10 are within effective broadcast range of wireless transmission 65.

Although the present invention has been described in considerable detail with reference to certain preferred configurations, other versions are possible. Different components may be used in speaker systems according to the invention and the speaker system components may be arranged in different ways. For instance, different springs may be used and can be attached to the speaker systems in different locations. Therefore, the spirit and scope of the appended claims should not be limited to the preferred version as described above.

I claim:

1. A spa apparatus, comprising:

a first housing comprising a generally circular cross-section;

a second housing comprising a circular interior complementing the circular cross-section of said first housing, said first housing mounted within said interior of said second housing; and a mechanism enabling said first housing to be retracted into and extended from said housing, wherein said circular interior of said second housing enables said first housing to freely rotate within said second housing.

2. The apparatus of claim 1, further comprising a rotatable stage coupled to said first housing enabling said first housing to be rotated on a longitudinal axis with respect to said second housing.

3. The apparatus of claim 1, further comprising an audio or visual component mounted within said first housing.

4. The apparatus of claim 3, wherein said component comprises a speaker.

5. The apparatus of claim 1, wherein said first housing may freely rotate within said second housing when said first housing is in various extended and retracted positions with respect to said second housing.

6. The apparatus of claim 2, wherein the extension and retraction of said stage causes said first housing to extend and retract from said second housing.

7. The apparatus of claim 1, wherein said mechanism comprises a spring bias urging said first housing to an extended position.

8. The apparatus of claim 7, wherein said first housing is hand-retractable into said second housing against said spring bias.

9. The apparatus of claim 7, wherein said spring bias is provided by a constant force coil spring.

10. The apparatus of claim 7, wherein said spring bias extends between said first housing and said second housing.

11. The apparatus of claim 1, further comprising a latch retaining said first housing in a retracted position within said second housing against said mechanism.

12. The apparatus of claim 11, wherein said latch is hand releasable.

13. The apparatus of claim 1, further comprising a retainer lip integral to said second housing, said retainer lip arranged to rest against a spa wall when said second housing is mounted within a spa, said first housing extendable from said wall as it extends from said second housing.

14. The apparatus of claim 1, wherein said mechanism further comprises a first housing stop to maintain said first housing in engagement with said second housing.

15. The apparatus of claim 1, wherein said mechanism further comprises a rotation stop to limit the rotation of said first housing.

16. A spa system comprising:

a spa;

a wall in said spa;

a first housing comprising a generally circular cross-section;

a second housing comprising a circular interior complementing the circular cross-section of said first housing, said first housing mounted within said interior of said second housing, said second housing mounted within said wall; and a mechanism enabling said first housing to be retracted into and extended from said second housing and said wall and enabling said first housing to be rotated.

17. The spa system of claim 16, further comprising a latch mechanism retaining said first housing in a retracted position.

18. The spa system of claim 16, wherein said circular interior of said second housing enables said first housing to freely rotate on a longitudinal axis within said second housing when said first housing is in various extended and retracted positions.

19. The system of claim 16, wherein said first housing is rotatably mounted on a stage, and said stage is extendable and retractable in relation to said second housing and said wall to extend and retract said first housing from said second housing and wall.

20. The apparatus of claim 16, further comprising an audio or visual component mounted within said first housing.

21. The system of claim 20, further comprising:

an audio or visual system, and an audio or visual signal produced by said audio or visual system, wherein said audio or visual component receives said signal from said audio or visual system.

22. The system of claim 21, wherein said audio or visual component further comprises a wireless receiver to receive said audio or visual signal from said audio or visual system.

23. A spa apparatus, comprising:

a first housing comprising a generally circular cross-section;

a second housing comprising a circular interior complementing the circular cross-section of said first housing, said first housing mounted within said interior of said second housing, said second housing mountable within a wall of a spa;

a support stage integral to said first housing and movable within said second housing; and an audio or visual component rotatably mounted to said stage, wherein movement of said stage within said second housing causes said audio or visual component to at least partially extend from said second housing and retract within said second housing, and said stage also adapted to allow said audio or visual component to rotate.

24. The apparatus of claim 23, wherein said circular interior of said second housing enables said first housing to freely rotate on a longitudinal axis within said second housing when said first housing is in various extended and retracted positions with respect to said second housing.

25. A spa speaker system, comprising:

a spa;

a wall in said spa;

a stage;

a plurality of audio or visual components mounted within said wall, each of said components mounted in a respective first housing with a substantially circular cross-section, with said first housing mounted in a circular interior of a respective second housing, said first housing further rotatably mounted on said stage enabling each of said mounted components to be rotated on a longitudinal axis independent of each of the other said components; and a mechanism enabling each of said components to be retracted into said wall and extended from said wall independent of each of the other said components;

wherein the cylindrical interior of said second housing enables said first housing to freely rotate on said longitudinal axis within said second housing.

* * * * *